US010556365B2

(12) United States Patent
Yamada et al.

(10) Patent No.: US 10,556,365 B2
(45) Date of Patent: Feb. 11, 2020

(54) METHOD OF MANUFACTURING CERAMIC STRUCTURE

(71) Applicant: NGK INSULATORS, LTD., Nagoya (JP)

(72) Inventors: Takuya Yamada, Nagoya (JP); Hirotada Nakamura, Nagoya (JP); Nobuyuki Umetsu, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 341 days.

(21) Appl. No.: 15/438,805

(22) Filed: Feb. 22, 2017

(65) Prior Publication Data

US 2017/0274555 A1 Sep. 28, 2017

(30) Foreign Application Priority Data

Mar. 25, 2016 (JP) ..... 2016-062772

(51) Int. Cl.

| | |
|---|---|
| ***B28B 17/00*** | (2006.01) |
| ***B28B 3/20*** | (2006.01) |
| ***B28B 11/24*** | (2006.01) |
| ***B28B 17/02*** | (2006.01) |

(52) U.S. Cl.

CPC ..... *B28B 17/0081* (2013.01); *B28B 3/20* (2013.01); *B28B 11/243* (2013.01); *B28B 17/026* (2013.01); *B28B 2003/203* (2013.01)

(58) Field of Classification Search

CPC ..... B28B 17/0081

See application file for complete search history.

(56) References Cited

U.S. PATENT DOCUMENTS

| | | | |
|---|---|---|---|
| 2003/0146539 | A1 | 8/2003 | Chen et al. |
| 2006/0061007 | A1 | 3/2006 | Chen et al. |
| 2006/0257620 | A1 | 11/2006 | Noguchi et al. |
| 2009/0134545 | A1 | 5/2009 | Signorini et al. |
| 2011/0049741 | A1 | 3/2011 | Brown et al. |
| 2012/0133065 | A1 | 5/2012 | Caffrey et al. |

FOREIGN PATENT DOCUMENTS

| | | | |
|---|---|---|---|
| JP | 2003-104776 | A1 | 4/2003 |
| JP | 2003-516880 | A1 | 5/2003 |
| JP | 2009-517251 | A1 | 4/2009 |
| JP | 2013-545641 | A | 12/2013 |
| WO | WO2005/018893 | A1 | 3/2005 |

OTHER PUBLICATIONS

Japanese Office Action (Application No. 2016-062772) dated Jul. 24, 2018 (with English translation).

*Primary Examiner* — Larry W Thrower
(74) *Attorney, Agent, or Firm* — Burr & Brown, PLLC

(57) ABSTRACT

A manufacturing method includes a mixing step, a kneading step of kneading a wet mixture, a liquid adding step of further adding a liquid to a kneaded material, a forming step of extruding a forming material of which viscosity is adjusted into a honeycomb formed body, a drying step of drying the honeycomb formed body, and a dimension measuring step of measuring a dry dimension of a honeycomb dried body that has been dried, where in the liquid adding step, the amount of the liquid to be added is adjusted based on the result of measuring the dry dimension of the honeycomb dried body.

5 Claims, 5 Drawing Sheets

METHOD OF MANUFACTURING CERAMIC STRUCTURE

"The present application is an application based on JP-2016-062772 filed on Mar. 25, 2016 with Japan Patent Office, the entire contents of which are incorporated herein by reference."

BACKGROUND OF THE INVENTION

Field of the Invention

The present invention relates to a method of manufacturing a ceramic structure. More specifically, the present invention relates to a method of stably manufacturing a ceramic structure having high dimensional accuracy.

Description of the Related Art

Conventionally, ceramic structures have widely been used in, for example, catalyst carriers for purifying exhaust gas of cars, filters for removing diesel particulates, and heat storages for combustion devices. Many of ceramic structures use a honeycomb structure having a honeycomb shape including, for example, partition walls arranged in a lattice cross-section to define a plurality of cells extending from one end face to the other end face to serve as through channels for fluid. Such a honeycomb structure is manufactured by extruding a forming material (kneaded material) through a die (extrusion die) of an extrusion machine to form a ceramic formed body having a desired shape and treating the ceramic formed body in a drying step and a firing step.

The forming material that is extruded through the die to form the ceramic formed body is prepared by mixing raw materials consisting of ceramic particulates, a binder and the like, with a predetermined compounding ratio and then by kneading so as to be adjusted to have a viscosity suitable for extrusion. To adjust the viscosity, a liquid containing at least one of water, surfactant, lubricant and, plasticizer, for example, is added to the forming material.

More specifically, a batch-mixing device (batch mixer) is first used that performs dry-mixing (first mixing) of the inorganic raw materials and the binder to form a uniformly mixed dry mixture and then performs wet-mixing (second mixing) to mix the added liquid, such as water, and the dry mixture to form a wet mixture. The wet mixture is then loaded into a kneading machine and kneaded into a kneaded material and eventually become a forming material having an adjusted viscosity suitable for extrusion.

The manufacturing process includes a step of determining the amount of the liquid, such as water, added in the wet-mixing (or the amount of water content in the batch material), a step of measuring each temperature of a barrel and a screw of the extrusion machine, a step of measuring the rotational speed of the screw, and a step of measuring the extruded shape of the extruded body (corresponding to the ceramic formed body) just after being extruded through the extrusion die. The extruded body is manufactured in a manner stably keeping the extruded shape of the extruded body by adjusting the batch material, the barrel temperature, the screw temperature, the screw rotational speed, and such to keep the extruded shape of the extruded body within an acceptable range and to keep the dimensional accuracy of the extruded body (see Patent Document 1).

[Patent Document 1] JP-A-2013-545641

SUMMARY OF THE INVENTION

Viscosity of a forming material largely depends on the amount of liquid, such as water, added during wet-mixing.

Moreover, the difference in viscosity significantly affects the mechanical load (torque) on the extrusion machine during extrusion, the formed dimension of the ceramic formed body after extrusion, and the shape retainability of the formed body for retaining its formed dimension. In some cases, the dry dimension of the ceramic dried body resulting from drying the ceramic formed body and the dimension of the ceramic structure as a final product (product dimension) are also affected.

In the drying step in which the ceramic formed body is dried to be transformed into the ceramic dried body, a drying shrinkage occurs by evaporation or transpiration of the liquid contained in the forming material. As a result, the size of the ceramic dried body (for example, a honeycomb diameter and a honeycomb length) after drying becomes smaller than that of the ceramic formed body before dried, namely, the honeycomb diameter is reduced. Moreover, a firing shrinkage may also occur during firing.

Therefore, to stably keep the product dimension of the ceramic structure (honeycomb structure) as the final product, the drying shrinkage and the firing shrinkage should be taken into consideration to determine the size of the ceramic formed body and the ceramic dried body and, in particular, the amount of the liquid, such as water, to be added to the forming material and the liquid content ratio (or water content ratio) of the forming material should be considered.

In the conventional manufacturing of the ceramic structure however, adding of liquid, such as water, during wet-mixing is often restricted and a portion of the liquid, such as water, evaporates into the ambient air during wet-mixing, kneading, and extrusion, which may result in a reduction in the liquid content ratio of the forming material. This results in a high adjusted viscosity and might cause trouble such as an increase in the torque during extrusion.

As disclosed in Patent Document 1, an adjustment of the extruding condition, such as the water content in the batch material, based on the extruded dimension of the extruded body just after extrusion has been tried, whereas two-stage adjustment of the amount of liquid to be added in the wet-mixing and the kneading, that is, adding the liquid to be contained in the forming material to the kneaded material just before extrusion based on the dry dimension of the ceramic dried body after the drying step, has not been performed.

Moreover, in the conventional method of manufacturing, when the formed dimension of the ceramic formed body or the dry dimension of the ceramic dried body deviates from a specified standard dimension, the extrusion machine should temporarily be stopped to replace a die tool provided in the extrusion machine or to improve penetrability of the forming material that penetrates the die to adjust the extruding speed. This might result in a long down time of the extrusion machine, which deteriorates the manufacturing efficiency of the ceramic structure.

The present invention is made in view of the aforementioned circumstances. The present invention provides a method of manufacturing a ceramic structure that adjusts the amount of liquid to be added to the kneaded material based on the dry dimension of the ceramic dried body to stabilize the dimensional accuracy of the ceramic formed body and the ceramic dried body and can adjust the viscosity of the forming material suitable for extrusion without stopping the extrusion machine.

According to the present invention, a method of manufacturing a ceramic structure described below will be provided.

According to the present invention, a method of manufacturing a ceramic structure is provided including a dry-mixing step of dry-mixing by a batch process a raw material for forming a ceramic formed body, a wet-mixing step of adding a liquid including at least one of water, surfactant, lubricant, and plasticizer to a dry mixture obtained by the dry-mixing step and performing wet-mixing, a kneading step of kneading a wet mixture obtained by the wet-mixing step, a liquid adding step, performed in the kneading step, of further adding the liquid to a kneaded material formed by kneading the wet mixture, a forming step of extruding a forming material of which viscosity is adjusted by the kneading step and the liquid adding step into a ceramic formed body, a drying step of drying the ceramic formed body, and a dimension measuring step of measuring a dry dimension of a ceramic dried body obtained by the drying step, wherein in the liquid adding step, an amount of the liquid to be added to the kneaded material is adjusted based on a result of measuring the dry dimension of the ceramic dried body in the dimension measuring step.

According to a second aspect of the present invention, the method of manufacturing a ceramic structure according to the first aspect is provided, where the amount of the liquid added in the liquid adding step is 1.5% by mass to 4.5% by mass of a total amount of the liquid added in the wet-mixing step and the liquid adding step.

According to a third aspect of the present invention, the method of manufacturing a ceramic structure according to the first or second aspects is provided, wherein the dimension measuring step includes an image capturing step of capturing an image of either one of dried body end faces of the ceramic dried body, and an image analyzing step of comparing an end face image of the dried body end face captured in the image capturing step with a standard image of a previously specified standard dried body end face to detect a deviation of the end face image from the standard image and performing imagery-analysis, and in the liquid adding step, an amount of the liquid to be added to the kneaded material is determined based on a result of the imagery-analysis performed in the image analyzing step.

According to a fourth aspect of the present invention, the method of manufacturing a ceramic structure according to the first or second aspects is provided, wherein the dimension measuring step includes a dimensional data obtaining step of emitting a laser to a dried body surface of the ceramic dried body to obtain a total dimensional data related to a total dimension of the ceramic dried body, and a dimension analyzing step of comparing the total dimensional data obtained by the dimensional data obtaining step with a previously specified standard total dimensional data to detect a deviation of the total dimensional data from the standard total dimensional data and performing analysis, and in the liquid adding step, an amount of the liquid added to the kneaded material is determined based on a result of analysis on a total dimension in the dimension analyzing step.

The According to a fifth aspect of the present invention, the method of manufacturing a ceramic structure according to any one of the first to fourth aspects is provided, where the kneading step and the forming step are integrally and continuously performed.

According to a method of manufacturing a ceramic structure of the present invention, a liquid is added based on the dry dimension of a ceramic dried body to manufacture a ceramic structure having stable dimensional accuracy. In particular, the viscosity of the forming material is adjusted to control the dry dimension of the ceramic dried body without such a work as adjustment or replacement of the die, so that the extrusion of the ceramic formed body can be continued during the adjustment. As a result, a ceramic structure having high dimensional accuracy can be obtained.

DESCRIPTION OF THE PREFERRED EMBODIMENTS

An embodiment of a method of manufacturing a ceramic structure according to the present invention will now be described with reference to the drawings. The present invention is not limited to the embodiment described below. Alteration, modification, improvement, or such may be made without departing from the scope of the invention.

A method of manufacturing a ceramic structure 1 according to an embodiment of the present invention (hereinafter simply referred to as "manufacturing method 1") is for manufacturing a honeycomb structure (corresponds to a ceramic structure of the present invention) having high dimensional accuracy. The manufacturing method 1 relates, in particular, to an extrusion process for forming a honeycomb formed body 2 (corresponds to a ceramic formed body of the present invention) and, moreover, to a drying process and a dimension measuring process performed after the extrusion process.

Figure 1:
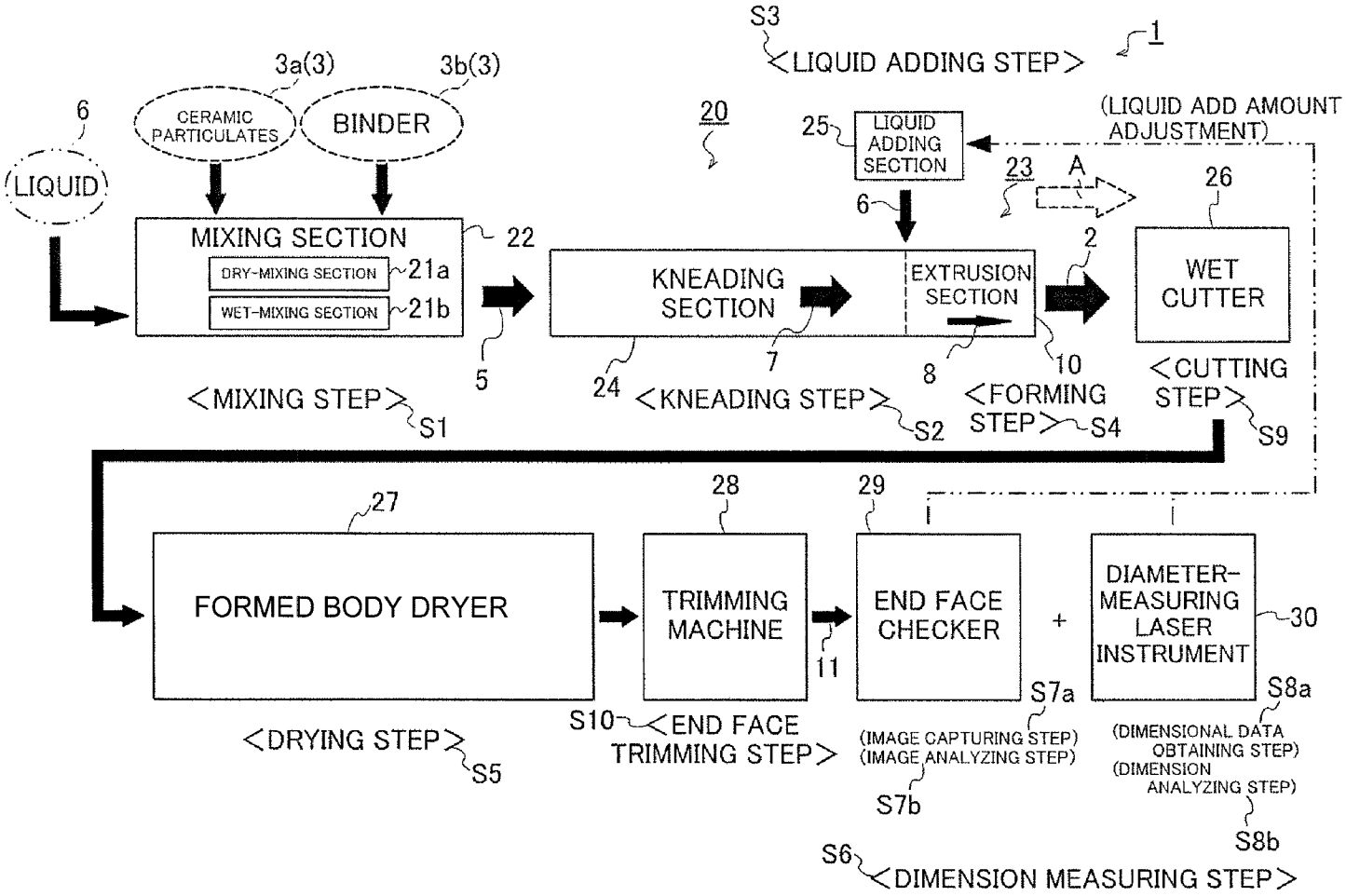
FIG. 1 is an explanatory view schematically illustrating an example of a flow of a method of manufacturing a ceramic structure according to one embodiment of the present invention and a structure manufacturing apparatus used in the method.

As illustrated in the drawings, such as FIG. 1, the manufacturing method 1 according to the embodiment mainly includes a mixing step S1, a kneading step S2, a liquid adding step S3, a forming step S4, a drying step S5, and a dimension measuring step S6. In the manufacturing method 1 according to the embodiment, the honeycomb formed body 2 formed by extruding a forming material 8 includes, between one end face and the other end face of the honeycomb formed body 2, partition walls arranged in a lattice cross-section to define a plurality of cells serving as through channels for fluid. In the manufacturing method according to the embodiment, the ceramic formed body and the ceramic structure are not limited to the honeycomb formed body 2 and the honeycomb structure formed from the honeycomb formed body 2 above described.

Each step will now be described more specifically. In the mixing step S1, various types of raw material 3 for forming the honeycomb formed body 2 are dry-mixed by a batch process, and a liquid 6, such as water, is added to a dry mixture obtained by the dry-mixing and mixed by wet-mixing (the step corresponds to a dry-mixing step and a wet-mixing step of the present invention).

Meanwhile, in the kneading step S2, a wet mixture 5 including the liquid 6 obtained by the mixing step S1 is kneaded to form a kneaded material 7. The liquid adding step S3 is performed in the kneading step S2 to further add the liquid 6 to the kneaded material 7 obtained by kneading the wet mixture 5. In the forming step S4, the liquid 6 is further added to the kneaded material 7 and the forming material 8 of which viscosity is adjusted is extruded through a die 10 using an extrusion machine to form the honeycomb formed body 2. The drying step S5 is performed to dry the extruded honeycomb formed body 2 under a drying condition. In the dimension measuring step S6, the dry dimension of a honeycomb dried body 11 obtained by drying is measured.

The manufacturing method 1 according to the embodiment further includes between the forming step S4 and the drying step S5, a cutting step S9 in which the extruded honeycomb formed body 2 which is not yet dried is cut into a previously specified length and between the drying step S5 and the dimension measuring step S6 an end face trimming step S10 in which a dried body end face 13 of the dried honeycomb dried body 11 is trimmed.

The dimension measuring step S6 includes an image capturing step S7*a* in which an end face image 14 of one of (or the other one of) the dried body end faces 13 of the honeycomb dried body 11 is captured and an image analyzing step S7*b* in which the captured end face image 14 is compared with a previously specified standard image (not shown) of a predetermined standard dried body end face of a standard dried body and the deviation of the end face image 14 from the standard image is detected and imagery-analyzed. A first dimension measurement is performed in the dimension measuring step S6 to adjust the amount of the liquid 6 to be added to the kneaded material 7 based on the result of the imagery-analysis. The dimension measuring step S6 further includes a dimensional data obtaining step S8*a* in which a laser L is emitted to a plurality of places on the dried body surface 15 of the honeycomb dried body 11 to obtain a total dimensional data related to the total dimension of the honeycomb dried body 11 and a dimension analyzing step S8*b* in which the obtained total dimensional data is compared with a previously specified standard total dimensional data (not shown) and the deviation of the total dimensional data from the standard total dimensional data is detected and analyzed. A second dimension measurement is performed in the dimension measuring step S6 to adjust the amount of the liquid 6 added to the kneaded material 7 based on the result of the total dimensional analysis.

As schematically illustrated in FIG. 1, the manufacturing method 1 according to the embodiment can be performed using a structure manufacturing apparatus 20 that can perform the steps S1 to S10. The structure manufacturing apparatus 20 mainly includes a dry-mixing section 21*a* (corresponding to a dry mixer) for dry-mixing by a batch process the raw material 3 composed of several types of ceramic particulates 3*a* and a binder 3*b* with a predetermined compounding ratio, a wet-mixing section 21*b* (corresponding to a wet mixer) for adding the liquid 6 to an obtained dry mixture and performing wet-mixing, a kneading section 24 (kneader) that kneads and conveys a wet mixture 5 mixed by a mixing section 22 to an extrusion section 23 of the extrusion machine, a liquid adding section 25 joined to the kneading section 24 (or the extrusion section 23) to further add the liquid 6 to the kneaded material 7 that has been kneaded, and the extrusion section 23 for extruding the forming material 8 obtained by adding the liquid 6 to the kneaded material 7 into a honeycomb formed body 2.

Other components of the structure manufacturing apparatus 20 includes a wet cutter 26 that performs the cutting step S9 in which a flat round pillar-shaped honeycomb formed body 2 extruded from the extrusion section 23 in a horizontal extruding direction A (see FIG. 1) is cut into a predetermined length, a formed body dryer 27 that performs the drying step S5 in which the cut honeycomb formed body 2 is dried under a predetermined drying condition, a trimming machine 28 that performs the end face trimming step S10 in which the honeycomb dried body 11 that has been treated in the drying step S5 is cut into a predetermined length, an end face checker 29 (end face profile shape measuring instrument) for performing the first dimension measurement in which two dimension measuring steps S6 are performed on the honeycomb dried body 11, and a diameter-measuring laser instrument 30 for performing the second dimension measurement. In the drying step S5, dielectric drying, microwave drying, hot air drying, or combinations thereof may be performed.

In the structure manufacturing apparatus 20, the mixing section 22, the extrusion section 23, the kneading section 24, the wet cutter 26, the formed body dryer 27, the trimming machine 28, and other components each may employ a known configuration used for conventional extrusion of a honeycomb formed body or the like. The extrusion section 23 of the structure manufacturing apparatus 20 corresponds to the extrusion machine.

In the structure manufacturing apparatus 20, the kneading section 24 and the extrusion section 23 (extrusion machine) are continuously integrated. Thus, a kneading space inside the kneading section 24 communicates with an extrusion space inside the extrusion section 23.

In the manufacturing method 1 according to the embodiment, the liquid 6 added in each of the wet-mixing section 21*b* of the mixing section 22 and the liquid adding section 25 is not particularly limited. At least one among water, surfactant, lubricant, and plasticizer may be used as the liquid 6 to be added. By adding the liquid 6 to the raw material 3 and through the subsequent mixing process and kneading process, the forming material 8 can be obtained as a uniform continuous material having a suitable viscosity to be extruded through the die 10 of the extrusion section 23.

Further describing the steps S1 to S10 and the configuration of the structure manufacturing apparatus 20 in more detail, the mixing step S1 includes dry-mixing performed using the dry-mixing section 21*a* of a batch type in which the raw material 3 composed of the ceramic particulates 3*a* and the binder 3*b* is churned and mixed. By this dry-mixing, the ceramic particulates 3*a* of several types of powders or particulates and the binder 3*b* weighed into a specified compounding ratio are uniformly mixed into a dry mixture in which several types of raw material 3 are uniformly dispersed.

The dry mixture resulting from the batch process is then transferred to the wet-mixing section 21*b* and mixed with an added liquid 6 (for example, water). The wet-mixing section 21*b* may be of a batch type or a continuous type. By this mixing, the liquid 6 is uniformly dispersed in the dry mixture and the mixed wet mixture 5 is obtained.

To further form the wet mixture 5 obtained by the mixing step S1 (wet-mixing section 21*b*) into the forming material 8 having a viscosity suitable for extrusion, the kneading step S2 is performed in the kneading section 24. As described above, in the structure manufacturing apparatus 20 for the manufacturing method 1 according to the embodiment, the kneading step S2 and the subsequent forming step S4 is continuously and integrally performed. Thus, as illustrated in FIG. 1, the kneading section 24 and the extrusion section 23 are joined to each other.

The wet mixture 5 to which the liquid 6 is added in the wet-mixing section 21*b* is loaded through a mixture inlet provided at an end of the kneading section 24 and transferred to the kneading space inside the kneading section 24. In the kneading space of the kneading section 24, the wet mixture 5 (or the kneaded material 7) is gradually kneaded as the wet mixture 5 is conveyed in the horizontal conveying direction toward the extrusion section 23.

The kneaded material 7 is kneaded in the kneading section 24 and conveyed to a position close to the die 10 of the extrusion section 23. The conveyed kneaded material 7 (forming material 8) is extruded through a plurality of slits (not shown) provided in the die 10 of the extrusion section 23 in the extruding direction A (see FIG. 1) by a predetermined extrusion amount and at a predetermined extruding pressure. A honeycomb formed body 2 is thereby formed. Then, steps such as wet cutting, drying, and firing are performed and manufacturing of the ceramic structure as a product is completed.

The manufacturing method 1 according to the embodiment includes the liquid adding step S3 in which the liquid 6 is further added from the liquid adding section 25 to the kneaded material 7 obtained by kneading the wet mixture 5 loaded in the kneading section 24 in the kneading step S2 described above. Thus, besides adding the liquid 6 in the mixing step S1 (wet-mixing section 21*b*), there is a chance of further adding the liquid 6 just before the extrusion performed in the forming step S4 (extrusion section 23). That is, there are two stages to add the liquid 6 during the forming of the forming material 8 to be extruded as the honeycomb formed body 2.

It takes a long period of time to form the raw material 3 eventually into the forming material 8 through the state of the dry mixture, the wet mixture 5, and the kneaded material 7 (kneading step S2). For this reason, after adding the liquid 6 in the mixing step S1, a portion of the added liquid may gradually be lost by the effect of the environment and the liquid content ratio changes while the material is formed into the forming material 8. In the manufacturing method 1 according to the embodiment, the liquid content ratio of the forming material 8 can be kept constant by further adding the liquid 6 before the forming step S4.

The amount of the liquid 6 added in the liquid adding step S3 is set smaller than the amount of the liquid 6 added in the wet-mixing section 21*b* in the mixing step S1, specifically, within the range from 1.5% by mass to 4.5% by mass of the total amount of the liquid 6 added in the mixing step S1 and the liquid adding step S3.

In more detail, the amount of the liquid 6 added in the liquid adding step S3 is determined within the abovementioned value range based on the result of the dimension measuring step S6 in which the dry dimension of the honeycomb dried body 11 obtained by drying the honeycomb formed body 2 is measured. In the manufacturing method 1 according to the embodiment, drying is performed by the formed body dryer 27 (drying step S5), and the first dimension measurement in which the dry dimension is measured for every honeycomb dried body 11 after the end face trimming (end face trimming step S10) and the second dimension measurement in which a part of the honeycomb dried bodies 11 is picked out after the end face trimming are performed and the dry dimension of the extracted honeycomb dried bodies 11 is measured. Each of the dimension measuring steps S6 will now be described in detail.

(1) First Dimension Measurement

Figure 2:
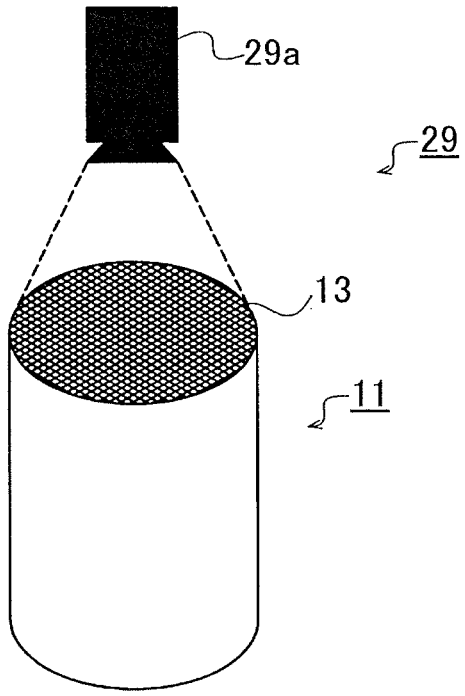
FIG. 2 is an explanatory view schematically illustrating an example image capturing step in which an image of a dried body end face of a ceramic dried body is captured.
Figure 3:
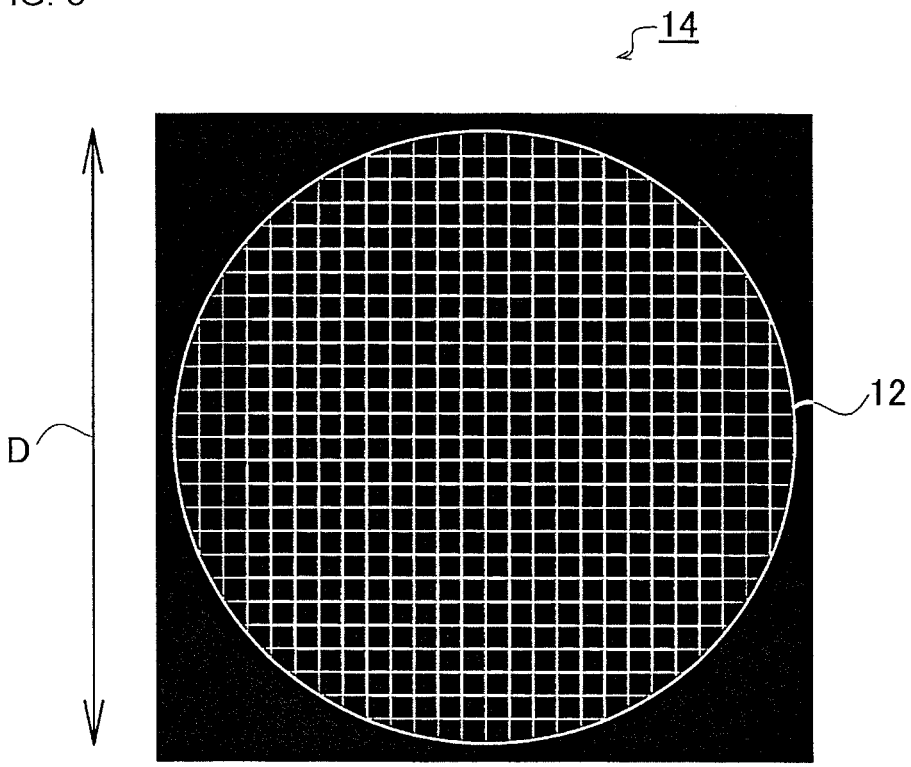
FIG. 3 is an explanatory view illustrating an end face image of a dried body end face captured in the image capturing step.

With the axial direction of the honeycomb dried body 11 (identical to the extruding direction A) set vertical, a camera 29*a* constituting a part of the end face checker 29 is disposed so as to oppose the dried body end face 13 facing upward (see FIG. 2). Under this state, an end face image 14 of the dried body end face 13 is captured (see FIG. 3). From the obtained end face image 14, a profile 12 of the honeycomb dried body 11 is detected by imagery-analysis, and the measured honeycomb diameter D of the honeycomb dried body 11 is calculated. Then, the difference between the calculated measured honeycomb diameter D and the standard honeycomb diameter of the standard honeycomb dried body is derived. The profile 12 is detected by imagery-analyzing a portion including pixels with high contrast in the captured end face image 14 to determine the profile shape of the dried body end face 13. The measured honeycomb diameter D is derived from the obtained profile shape. Capturing and the subsequent imagery-analysis processing of the end face image 14 are performed on every honeycomb dried body 11 that has finished the drying step S5. The average value (product average diameter difference) of the deviation from the standard honeycomb diameter per a unit time is calculated. The amount of the liquid 6 to be added is determined and previously specified based on the product average diameter difference, and the determined value is fed back to the liquid adding section 25 (see the two-dotted chain arrow in FIG. 1).

(2) Second Dimension Measurement

With the axial direction of the honeycomb dried body 11 (identical to the extruding direction A) set vertical, the honeycomb dried body 11 is placed on a turn table 30*b* which is a part of the diameter-measuring laser instrument 30 with the dried body end face 13 facing upward. A laser L is emitted from a laser displacement meter 30*a* constituting the diameter-measuring laser instrument 30 disposed aside the circumferential side face of the honeycomb dried body 11 (so as to oppose the circumferential side face in a direction perpendicular to the axial direction) (see FIG. 4). The laser L emitted from a light source (not shown) of the laser displacement meter 30*a* reaches the circumferential side face (dried body surface 15) of the honeycomb dried body 11, which is the target to be measured, and reflects. By detecting the reflected laser L with the light-receiving device (not shown), the dimension is measured based on the principle of triangulation. The honeycomb dried body 11, placed on the turn table 30*b*, rotates in the rotational direction R while receiving the laser L. That is, the dimension of the circumferential side face at a constant height is measured.

Figure 4:
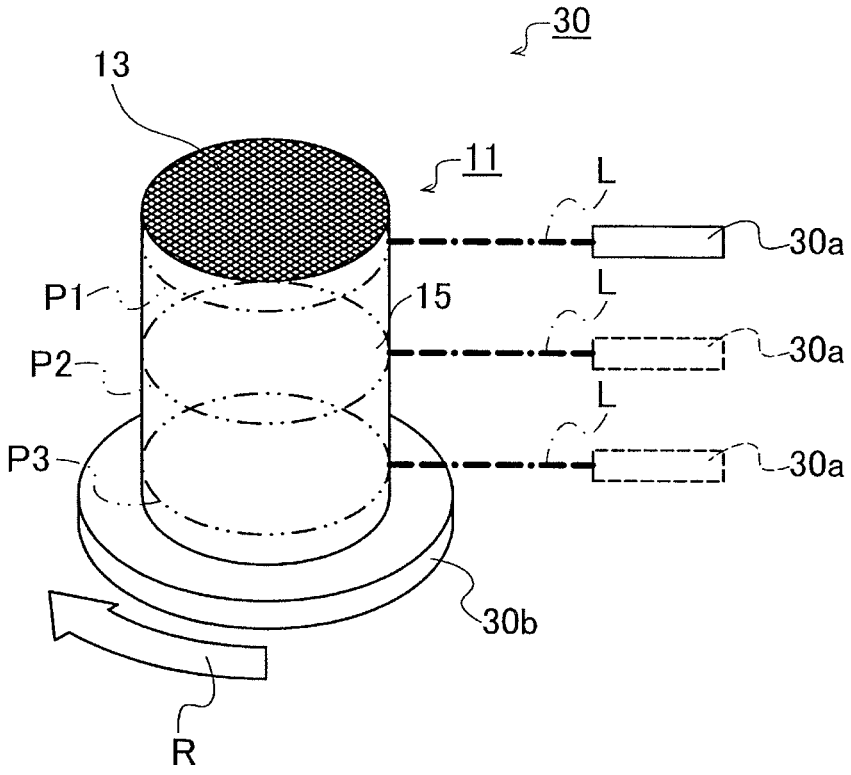
FIG. 4 is an explanatory view schematically illustrating an example dimensional data obtaining step using a diameter-measuring laser instrument performed on a ceramic dried body.

As illustrated in FIG. 4, the position (height) of the laser displacement meter 30*a* is changed to obtain the total dimensional data of the dried body surface 15 at a plurality of positions (laser irradiation points P1, P2, and P3) in the axial direction of the honeycomb dried body 11. Then, in a similar manner, the difference between the obtained total dimensional data and the total dimensional data of the standard honeycomb dried body is derived to obtain the product average diameter difference. This is performed for picked out honeycomb dried bodies 11 and the average value of the deviation from the total dimensional data of the standard honeycomb formed body per unit time is calculated. The amount of the liquid 6 to be added is determined and previously specified based on the obtained difference, and the determined value is fed back to the liquid adding section 25 (see the two-dotted chain arrow in FIG. 1).

Example

A method of manufacturing a ceramic structure according to the present invention will now be described based on the following example. The ceramic structure according to the present invention is not limited to the example.

(1) Forming of Honeycomb Dried Body (Ceramic Dried Body)

A honeycomb structure, which is of a type of a ceramic dried body, was formed by the method of manufacturing a ceramic structure using a structure manufacturing apparatus. To dry a honeycomb formed body, high-frequency drying of 10 MHz or above using a dielectric dryer was performed and then blow drying with hot air of 150° C. or below using a hot air dryer was performed. A detailed description of other processes of forming the honeycomb structure, which has conventionally been known, is omitted.

(2) Dimension Measurement of Honeycomb Dried Body

The first dimension measurement and the second dimension measurement described above were performed on a dried body end face and a dried body surface to measure the dry dimension of a honeycomb dried body. In the first dimension measurement, an image of the dried body end face on the top side was captured by a camera and the captured image was imagery-analyzed. The accuracy of the end face image captured by the camera is within the range of ±0.06 mm, and the repetitive accuracy of the honeycomb diameter is ±0.04 mm.

In the second dimension measurement, a laser was emitted using a laser displacement meter to the honeycomb dried body at a location 6 mm below the top face of the honeycomb dried body (one of the dried body end faces) (laser irradiation point P1), a location in the center of the length in the axial direction (honeycomb length) (laser irradiation point P2), and a location 6 mm above the bottom face of the honeycomb dried body (the other dried body end face) (laser irradiation point P3) to perform a laser measurement based on triangulation.

(3) Change in Die Front Pressure Caused by Adding Liquid

Figure 5:
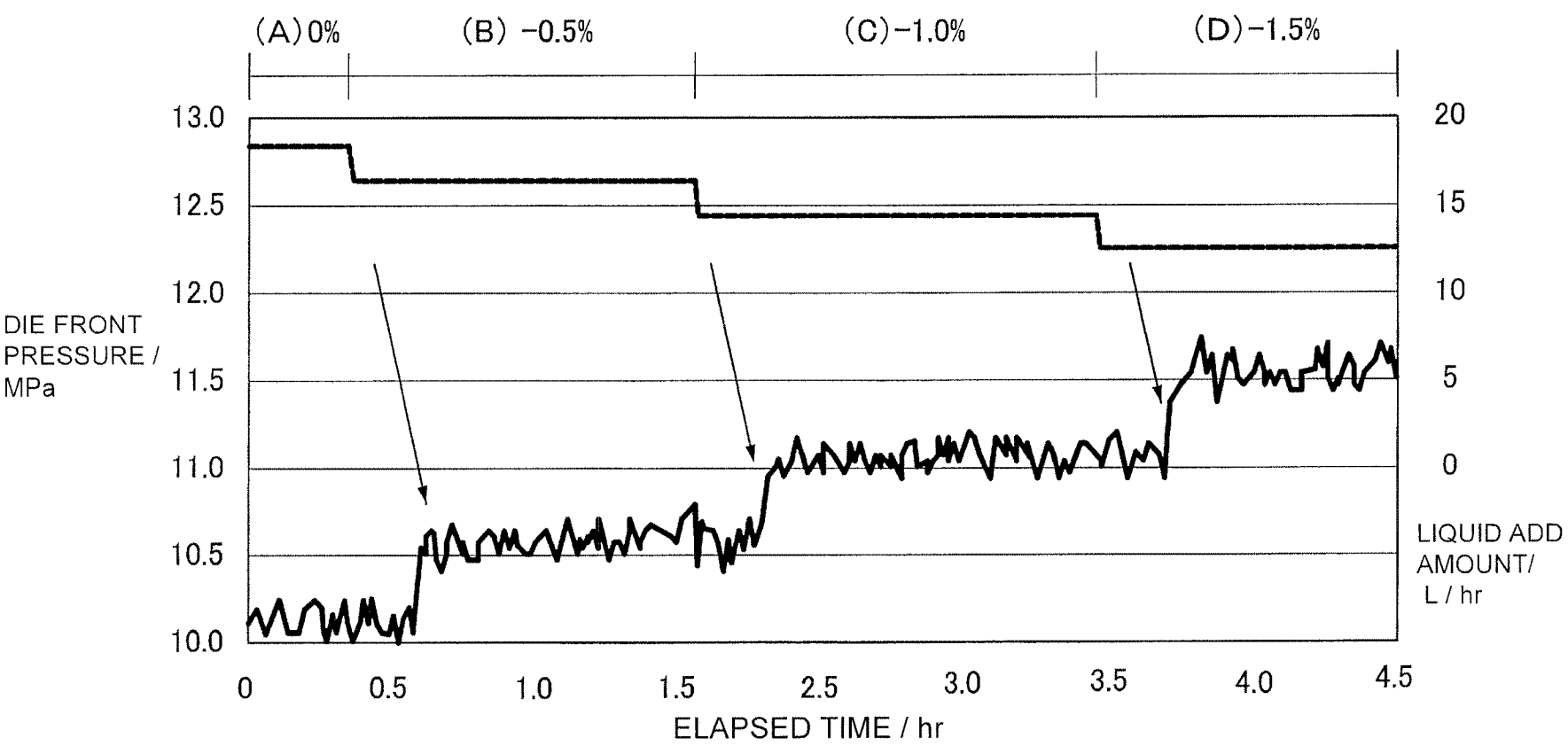
FIG. 5 is a chart illustrating a change in die front pressure caused by adding a liquid.

FIG. 5 illustrates a change in die front pressure caused by adding liquid. The horizontal axis represents the elapsed time, and the vertical axis represents the pressure (see the values on the left vertical axis) at an immediate upstream of a die with which extrusion is performed. The dashed line in the chart represents the amount of the liquid added per an hour (see the values on the right vertical axis). The amount of added liquid was not reduced in range (A) shown on the top of the chart but was reduced by −0.5% by mass in range (B), −1.0% by mass in range (C), and by −1.5% by mass in range (D).

Accordingly, the viscosity of a forming material increases by decreasing the amount of added liquid. As a result, the rise in the die front pressure was observed. In the example, the effect caused by adding the liquid was observed in a relatively short period of time, about 15 to 20 minutes, after changing the added amount of the liquid (see arrows in FIG. 5). That is, the viscosity of the forming material immediate before extrusion can be controlled by adding the liquid by the liquid adding section, and thereby the extruding condition can be stabilized.

(4) Change in Product Average Diameter Difference Caused by Adding Liquid

Figure 6:
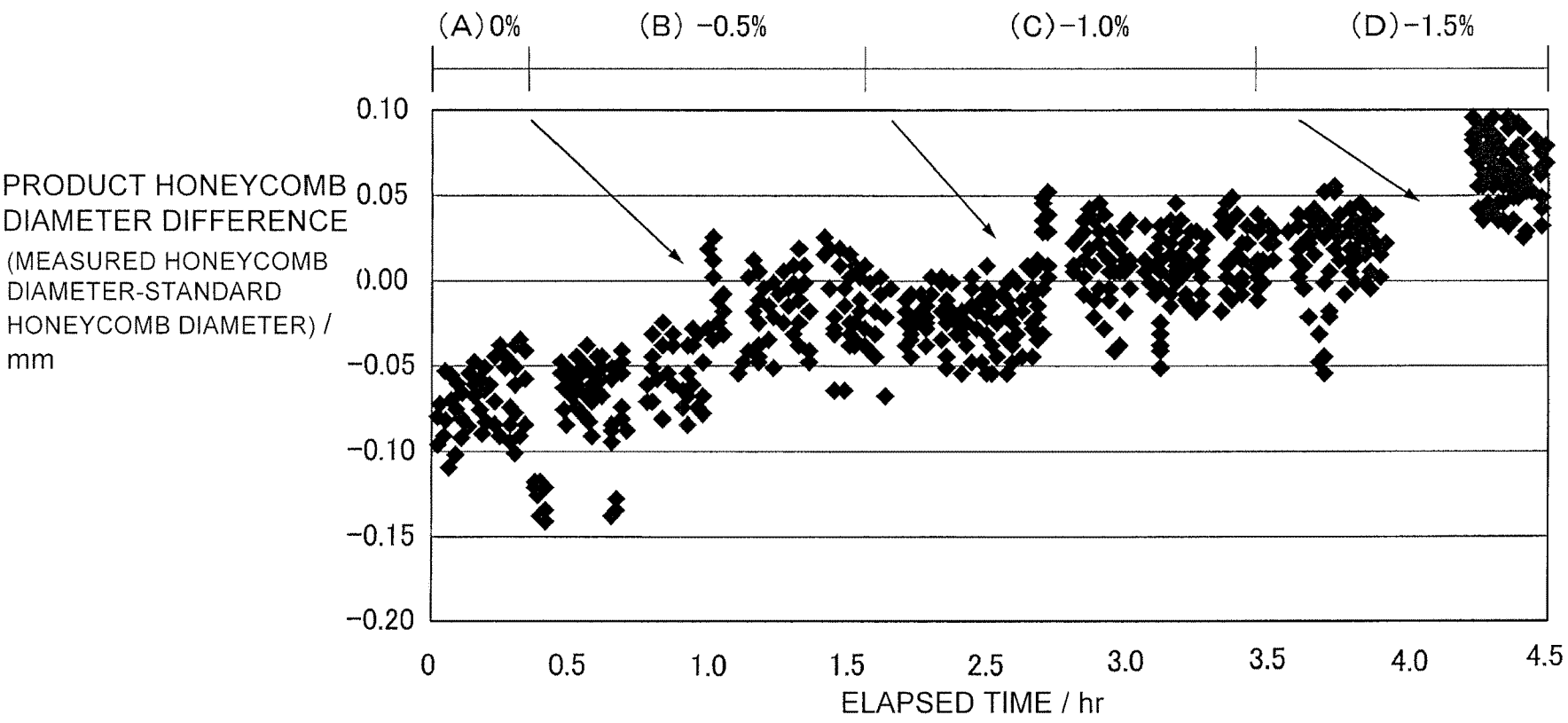
FIG. 6 is a chart illustrating a change in product average diameter difference caused by adding a liquid.

FIG. 6 illustrates a change in a product average diameter difference caused by adding the liquid. The horizontal axis represents the elapsed time, and the vertical axis represents the difference between the measured honeycomb diameter and the standard honeycomb diameter (product average diameter difference), where the measured honeycomb diameter is obtained by the first dimension measurement in which capturing, imagery-analysis, and calculation are performed on the image of the dried body end face of each honeycomb dried body. Descriptions on (A), (B), (C), and (D) on the top of the chart, which are the same as FIG. 5, are omitted.

In the example, the effect caused by reducing the amount of added liquid was observed in about 30 to 40 minutes after the start of the change (see arrows in FIG. 6). According to the embodiment (for example, by comparing (A) and (C)), the change in the amount of added liquid by 1.0% by mass can change the measured honeycomb diameter of the honeycomb dried body by about 0.1 mm.

If an increase of the difference between the standard honeycomb diameter and the measured honeycomb diameter is observed by measuring the dry dimension of the honeycomb dried body in manufacturing of the honeycomb structure, the dry dimension of the honeycomb dried body can be controlled by increasing or decreasing the amount of the liquid added by the liquid adding section. Moreover, the effect caused by adding the liquid was observed after adding the liquid in a relatively short period of time, that is, in about 20 minutes for the die front pressure and in about 40 minutes for the dry dimension of the honeycomb dried body.

Therefore, a conventional operation of stopping the extrusion machine or the like to replace or adjust the die can be omitted. That is, in the step of manufacturing the honeycomb dried body, the dry dimension can be controlled by 0.1 mm by slightly adjusting the amount of the added liquid based on the measured dimension, which thereby stabilizes the dimensional accuracy of the honeycomb structure as the final product. Moreover, since the extrusion machine needs not be stopped, the operational efficiency and productivity can be improved.

The example is illustratively described above, not by way of limitation, for the honeycomb structure and the honeycomb dried body having a honeycomb shape. The embodiment may be described for other ceramic structures and ceramic dried bodies.

A method of manufacturing a ceramic structure according to the present invention can be used for manufacturing a ceramic structure usable for catalyst carriers for purifying exhaust gas of cars, filters for removing diesel particulates, or heat storages for combustion devices.

DESCRIPTION OF REFERENCE NUMERALS

1:method of manufacturing, 2:honeycomb formed body (ceramic formed body), 3:raw material, 3*a*:ceramic particulates, 3*b*:binder, 4:wet mixture, 6:liquid, 7:kneaded material, 8:forming material, 10:die, 11:honeycomb dried body (ceramic dried body), 12:profile, 13:dried body end face, 14:end face image, 15:dried body surface, 20:structure manufacturing apparatus, 21*a*:dry-mixing section, 21*b*:wet-mixing section, 22:mixing section, 23:extrusion section, 24:kneading section, 25:liquid adding section, 26:wet cutter, 27:formed body dryer, 28:trimming machine, 29:end face checker, 29*a*:camera, 30:diameter-measuring laser instrument, 30*a*:laser displacement meter, 30*b*:turn table, A:extruding direction, L:laser, P1, P2, P3:laser irradiation point, R:rotational direction, S1:mixing step (dry-mixing step, wet-mixing step), S2:kneading step, S3:liquid adding step, S4:forming step, S5:drying step, S6:dimension measuring step, S7*a*:image capturing step, S7*b*:image analyzing step, S8*a*:dimensional data obtaining step, S8*b*:dimension analyzing step, S9:cutting step, S10:end face trimming step.

What is claimed is:

1. A method of manufacturing a ceramic structure comprising:

a dry-mixing step of dry-mixing by a batch process a raw material for forming a ceramic formed body;

a wet-mixing step of adding a liquid including at least one of water, surfactant, lubricant, and plasticizer to a dry mixture obtained by the dry-mixing step and performing wet-mixing;

a kneading step of kneading a wet mixture obtained by the wet-mixing step;

a liquid adding step, performed in the kneading step, of further adding the liquid to a kneaded material formed by kneading the wet mixture;

a forming step of extruding a forming material of which viscosity is adjusted by the kneading step and the liquid adding step into a ceramic formed body;

a drying step of drying the ceramic formed body; and a dimension measuring step of measuring a dry dimension of a ceramic dried body obtained by the drying step, wherein in the liquid adding step, an amount of the liquid to be added to the kneaded material is adjusted based on a result of measuring the dry dimension of the ceramic dried body in the dimension measuring step.

2. The method of manufacturing a ceramic structure according to claim 1, wherein the amount of the liquid added in the liquid adding step is 1.5% by mass to 4.5% by mass of a total amount of the liquid added in the wet-mixing step and the liquid adding step.

3. The method of manufacturing a ceramic structure according to claim 1, wherein the dimension measuring step includes an image capturing step of capturing an image of either one of dried body end faces of the ceramic dried body, and an image analyzing step of comparing an end face image of the dried body end face captured in the image capturing step with a standard image of a previously specified standard dried body end face to detect a deviation of the end face image from the standard image and performing imagery-analysis, and in the liquid adding step, an amount of the liquid to be added to the kneaded material is determined based on a result of the imagery-analysis performed in the image analyzing step.

4. The method of manufacturing a ceramic structure according to claim 1, wherein the dimension measuring step includes a dimensional data obtaining step of emitting a laser to a dried body surface of the ceramic dried body to obtain a total dimensional data related to a total dimension of the ceramic dried body, and a dimension analyzing step of comparing the total dimensional data obtained by the dimensional data obtaining step with a previously specified standard total dimensional data to detect a deviation of the total dimensional data from the standard total dimensional data and performing analysis, and in the liquid adding step, an amount of the liquid added to the kneaded material is determined based on a result of analysis on a total dimension in the dimension analyzing step.

5. The method of manufacturing a ceramic structure according to claim 1, wherein the kneading step and the forming step are integrally and continuously performed.

* * * * *